United States Patent [19]

Cusack

[11] Patent Number: 4,795,317

[45] **Date of Patent: * Jan. 3, 1989**

[54] MAGNETOSTRICTIVE PUMP WITH REVERSIBLE VALVES

[75] Inventor: Robert F. Cusack, Grosse Pointe Park, Mich.

[73] Assignee: GTE Valeron Corporation, Troy, Mich.

[ * ] Notice: The portion of the term of this patent subsequent to Feb. 23, 2005 has been disclaimed.

[21] Appl. No.: 905,007

[22] Filed: Sep. 8, 1986

Related U.S. Application Data

[63] Continuation-in-part of Ser. No. 759,556, Jul. 26, 1985, abandoned, and Ser. No. 759,553, Jul. 26, 1985, abandoned.

[51] Int. Cl.[4] ..... F04B 17/00; F04B 35/00

[52] U.S. Cl. ..... 417/322; 417/410; 417/505; 310/26

[58] Field of Search ..... 417/322, 410, 417, 505; 310/26; 251/65; 137/532

[56] References Cited

U.S. PATENT DOCUMENTS

| | | | |
|---|---|---|---|
| 1,092,453 | 4/1914 | Rainey | 310/26 |
| 2,597,952 | 5/1952 | Rosenlund | 251/65 |
| 2,772,862 | 12/1956 | Van Suchtelen | 310/26 |
| 2,776,417 | 1/1957 | Harris | 310/26 |
| 2,842,067 | 7/1958 | Stevens | 310/26 |
| 3,175,132 | 3/1965 | Salter | 310/26 |
| 3,194,162 | 7/1965 | Williams | 417/322 |
| 3,349,304 | 10/1967 | Wachter | 310/26 |
| 3,391,680 | 7/1968 | Benson | 417/322 |
| 3,485,441 | 12/1969 | Eaton, Jr. | 417/505 |
| 4,096,735 | 6/1978 | Huntzinger et al. | 310/26 |

FOREIGN PATENT DOCUMENTS 2822442 12/1979 Fed. Rep. of Germany .... 417/417

*Primary Examiner*—Donald E. Stout
*Attorney, Agent, or Firm*—David J. Koris

[57] ABSTRACT

A hydraulic pump having a cylinder closed at one end with an elongated piston arranged within the cylinder from the other end. The piston is constructed of a positive magnetostrictive material which increases in length in the presence of a magnetic field of appropriate intensity. It is wound along its length with a coil of wire capable of producing an electro-magnetic field upon energization. The piston is fastened at the open end of the cylinder to define a cylinder cavity between the cylinder closed end and the piston. A pair of passages including valves, for use as an intake and an exhaust passage, settable as required, communicate with this cavity. The valve members in each cavity comprises a magnetically polarized member, each of opposed polarity as related to the other, such that upon energization of the pump with one polarity of pulses, the valves will assume a particular function, and with a reversed polarity of operating pulses, a reverse function. The volume of this cavity is reduced when the piston expands under the influence of the magnetic field created by the coil to produce a pressure on any fluid contained within said cavity to force it out the exhaust passage. In a preferred embodiment the cylinder is constructed of a negative magnetostrictive material which contracts or shrinks in length in the presence of magnetic field. Thus, in the preferred embodiment, upon energization of the coil, the cylinder's shrinkage and the piston's expansion double the relative movement of the piston force to increase the volume displacement of the pump.

14 Claims, 2 Drawing Sheets

MAGNETOSTRICTIVE PUMP WITH REVERSIBLE VALVES

CROSS REFERENCES TO RELATED APPLICATIONS

This application is related to the following copending applications of applicant filed at the same time and assigned to the same assignee:

Negative Magnetostrictive Pump, Ser. No. 905,006, now allowed.

Magnetrostrictive Hydraulic Injector, Ser. No. 904,447, now allowed.

Dual Magnetostrictive Pump with Reversable Valves, Ser. No. 918,220, now U.S. Pat. No. 4,726,741.

This application is a continuation-in-part of co-pending U.S. patent application Ser. No. 759,556 and Ser. No. 759,553 each having a filing date of July 26, 1985, both now abandoned.

FIELD OF INVENTION

This invention relates to a fluid pump and more particularly to a reciprocating piston pump wherein the piston is reciprocated magnetostrictively and the valves are conditioned by the polarity of the pulses used to operate the pump.

BACKGROUND OF INVENTION

It is known in the present state of the art to provide magnetically actuated pumps wherein an electromagnet is used to reciprocate a piston of flexible diaphragm through suitable linkage to provide the required volumetric displacement. These types of pumps however do not readily adapt themselves to applications where they are required to produce measured amounts of fluid at high pressures and where the output must be bidirectional.

It is also know that certain metals when placed in a magnetic field react by changing their dimensions. This effect is known as magnetostriction. A more thorough discussion of this phenomenon may be found in the book authored by Richard M. Bozorth titled "Ferro-Magnetism" and published by the D. Van Nostrand Co. Inc. (September 1968).

SUMMARY OF THE INVENTION

Accordingly, it is an object of the present invention to produce a hydraulic pump capable of producing a pressure utilizing the magnetostrictive effect.

It is another object of the present invention to produce a pump the direction of the output of which can be reversed.

It is another object of the present invention to utilize both the positive expansion and negative contractive magnetostrictive qualities in a single application in a hydraulic pump.

It is a further object of the present invention that the pump output a constant volume displacement for each operation.

These and other objects and features of the present inventions are accomplished in a simple cylindrical pump having a piston of magnetostrictive metal wrapped in an electromagnet and fastened at one end to the cylinder with the other end free within the cylinder to move axially.

The pump cylinder is closed at the end facing the piston's free end to enclose a cylinder cavity. By the provision of a pair of passages that can selectively perform as an intake and an exhaust passage with a valve arrangement communicating with said cavity, the piston ends reciprocating motion results in a pumping action governed by the strength of the magnetic field created by the coil and the constants of the metal used to make the piston and cylinder. The selective use of the passages is accomplished by including a permanent magnet in each valve member positioned with opposing poles at the common ends, such that a particular polarity of direct current used to operate the pump will cause the output to pass in one direction, and the opposite polarity of direct current will cause the output to pass in the opposite direction.

In an alternative embodiment, the cylinder is constructed of magnetostrictive material having a negative magnetostrictive quality.

BRIEF DESCRIPTION OF THE DRAWING

For a more complete understanding of the invention, reference may be had to the following detailed description of the invention in conjunction with the drawing wherein.

DESCRIPTIVE OF THE PREFERRED EMBODIMENT

Figure 1:
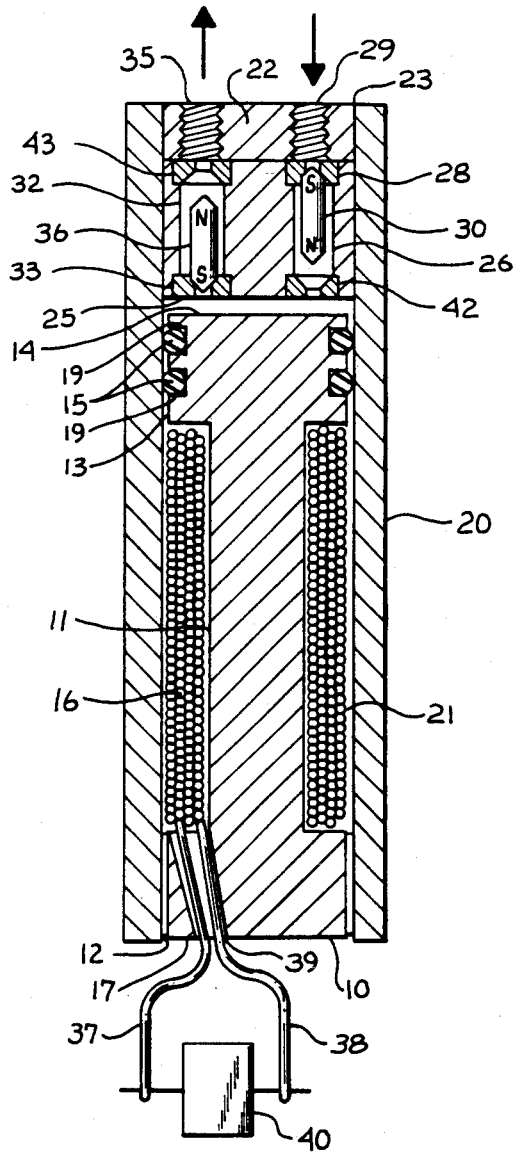
FIG. 1 illustrates in a sectional view the structure of the novel pump having an electro-magnetic coil wound about the piston.

The novel hydraulic pump of the present invention, as shown in FIG. 1, consists of a cylindrical housing 20 with a coaxial piston 10 within it. The cylindrical housing 20 is shown as made of a solid metal but in this preferred embodiment it would be laminated to enhance its performance at higher frequencies of operation. The piston should also be laminated or assembled of rods for the same reasons. The piston 10 is fastened at its base end 17 to the cylinders inner surface 21 at interface 12. The piston somewhat resembles a spool in that it has an axial recess 11 along its outer surface to receive a magnetizing coil 16 wound around it as a core. The coil terminals 37 and 38 are taken out via a passage 39 and may be connected to an energizing and control source shown at box 40. The unrecessed ends of the piston, the base end 17 and the piston face end 13 contain the coil as spool ends. The piston face end 13 as shown has two circumferential grooves 15 dimensioned to receive a pair of piston ring seals 19.

Figure 2:
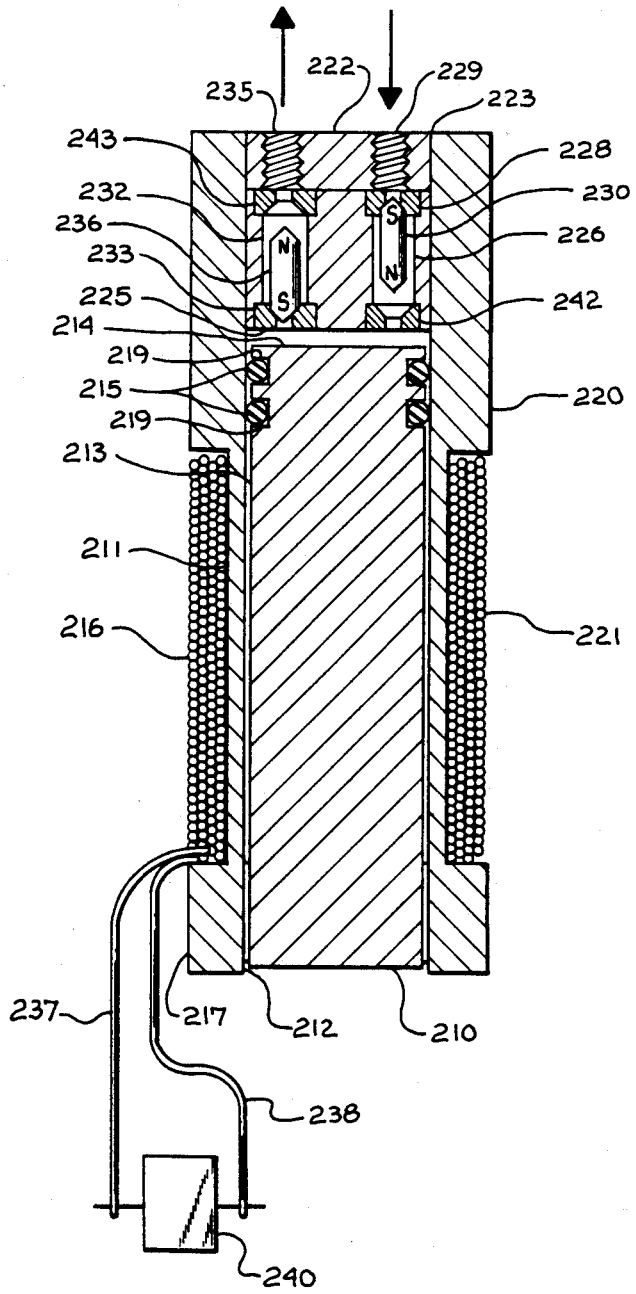
FIG. 2 illustrates in a sectional view the structure of the novel pump having an electro-magnet coil wound around the exterior of the cylinder.

In an alternate embodiment as shown in FIG. 2 the piston 210 does not have an axial recess for the magnetizing coil. The magnetizing coil 216 is wound around the exterior of the cylindrical shell 220. This arrangement is preferred for applications where it is required that the assembly be free to rotate axially. In such an application the cylindrical shell assembly would be constructed of a non-magnetic material to obviate the possibility of the flux being shunted away from the piston. In other respects the pumps would be similar and corresponding components arelabeled with the same numeral prefixed with a 2.

Referring to FIG. 1, the housing 20 of the pump further includes a cylinder head portion 22 suitably fastened to the cylinder's inner surface 21 at the interface 23. Within the cylinder head 22 are located a pair of passages 29 and 35 each including a valve chamber 26 and 32 with a valve assembly therein.

Each valve assembly includes magnetic valve seats 28 and 33 and double ended shuttle valve members 30 and 36. One unique feature of these members is that they include or may be made of a permanently magnetizeable material. Thus material is magnetized as a small bar magnet with its magnetic poles at the ends facing the valve seats. These shuttle members 30 and 36 are positioned in there respective valve chambers 26 and 32 so that they have opposite magnetic poles facing in a common direction. That is, as illustrated, the shuttle valve 36 in valve chamber 32 has it's south magnetic pole positioned toward the magnetic interior valve seat 33 which would have a north pole so as to provide a seat. Upon the pumping action the valve 36 is unseated. The valve arrangement as shown is only by the way of example for other suitable valve types may be used. Piston 10 is constructed of a material that has the property of expanding in the direction of an applied magnetic field. An alloy consisting of 49% cobalt, 49% iron and 2% vanadium, more generally known as 2 V Permadur is a material that has such a property and provides a displacement of 60 micro inches per inch of length. The magnetic field is supplied by the coil 16, the piston 10 expands lengthwise in the direction of magnetization to displace any fluid contained between the piston face 14 and the cylinder head surface 23 forcing the fluid out through the fluid passage 25 past the check valve 36. If the preferred embodiment is utilized, the cylinder 20 is constructed of a negative magnetostructive material such as nickel which provides a displacement of 35 microinches per inch of length with a magnetic field of 250H. The particular selection of materials recited herein is only by way of example. Other materials having the appropriate properties can be used, since inversely, the piston may be constructed of a material having contractive qualities and the cylinder of a material having expansion quality and still result in a pumping action having the resultant combined movement.

Upon cessation of the current flow through coil 16, the magnetic field within the coil collapses and the piston 10 responds by shrinking while the cylinder expands back in size to their respective initial lengths. This action reduces the pressure within the cylinder, drawing in additional fluid from passage 29 past the check valve assembly 30. This cycle of operation can then be repeated any number of times as required to move the desired amount of fluid. This pump readily lends itself to step or digital control, in that a measured amount of fluid is passed for each applied pulse thus, it is readily adaptable as a prime source for incremental tool control.

In the alternate embodiment, collapse of the magnetic field causes the piston 10 to respond to shrinking and the cylinder to respond by expanding back in size; both back to their initial lengths.

While but a single embodiments of the present invention have been shown it will be obvious to those skilled in the art that numerous other modifications may be made without departing from the spirit of the present invention which should be limited only by the scope of the claims appended hereto.

What is claimed is:

1. A fluid pump assembly for step control machine tool applications comprising:

a cylinder having a first and a second end, an elongate piston of a length shorter than said cylinder and having a first and second end, said piston formed of a positive magneto-strictive material, said first end of said piston secured to said first end of said cylinder, a cylinder head secured to said cylinder second end and having inlet and outlet passages to the exterior, each said passage including an elongate chamber having a magnetic valve seat, a valve member located in each said chamber, said valve members including permanent magnet means, said magnet means positioned in said chamber such that the comparable ends of said valves and said seats have opposite magnetic poles, means to interruptedly apply a magnetic field to said assembly of a first polarity, said means comprises a magnetic coil wound around the exterior of said cylinder, said piston operated responsive to said magnetic field to expand and expel any fluid located between said piston and head via an outlet passage.

2. A fluid pump assembly as claimed in claim 1 wherein said cylinder is formed of a negative magneto-strictive material.

3. A fluid pump assembly as claimed in claim 2 wherein said piston contracts and said cylinder expands to their original lengths upon collapse of said magnetic field to draw in any fluid at said inlet passage.

4. A fluid pump assembly as claimed in claim 1 wherein said piston includes a circumferentially depressed section between its ends and said means to interruptedly apply a magnetic field comprises a magnetic coil located in said depressed section.

5. A fluid pump assembly as claimed in claim 1 wherein said cylinder is formed of a non-magnetic material.

6. A fluid pump assembly as claimed in claim 1 wherein said cylinder is formed of nickel.

7. A fluid pump assembly as claimed in claim 1 wherein said piston is formed of an alloy consisting of 49% cobalt, 49% iron and 2% vanadium.

8. A fluid pump assembly as claimed in claim 7 wherein said cylinder is formed of nickel.

9. A fluid pump assembly as claimed in claim 1 wherein said means to interruptedly apply a magnetic field to said assembly is operated to apply a magnetic field of a second polarity.

10. A fluid pump assembly as claimed in claim 1 wherein said means to interruptedly apply a magnetic field to said assembly is operated to apply a magnetic field of a second polarity, said valve member operated in response to said second polarity to reverse their resepctive positions.

11. A fluid pump for step control machine tool applications assembly comprising:

a cylinder having a first and second end, said cylinder formed of a positive magneto-strictive material, an elongate piston of a length shorter than said cylinder and having a first and a second end, said piston formed of a negative magneto-strictive material, said first end of said piston secured to said first end of said cylinder, a cylinder head secured to said cylinder second end and having inlet and outlet passages to the exterior, each said passage including an elongate chamber having a magnetic valve seat, a valve member located in each said chamber, said valve members including permanent magnet means, said magnet means positioned in said valve members such that the comparable ends of said valves have opposite magnetic poles, means to interruptedly apply a magnetic field to said assembly of a first polarity, said means comprises a magnetic coil wound around the exterior of said cylinder, and said piston operated to contract in response to collapse of said magnetic field and said cylinder to expand to their original lengths and draw in any fluid via said outlet passage.

12. A fluid pump assembly as claimed in claim 11 wherein said piston is formed of an alloy consisting of 49% cobalt, 49% iron and 2% vanadium.

13. A fluid pump assembly as claimed in claim 11 wherein said means to interruptedly apply a magnetic field to said assembly is operated to apply a magnetic field of a second polarity.

14. A fluid pump assembly as claimed in claim 11 wherein said means to interruptedly apply a magnetic field to said assembly is operated to apply a magnetic field of a second polarity, said valve members operated in response to said second polarity to reverse their respective positions.

* * * * *